US006041955A

United States Patent [19]

Tisi et al.

[11] Patent Number: 6,041,955

[45] Date of Patent: Mar. 28, 2000

[54] CONTAINER BULKHEAD ASSEMBLY

[75] Inventors: Antony Luigi Paul Tisi, Benfleet; Andrew Stephen Paul Tisi, South Benfleet, both of United Kingdom

[73] Assignee: Philton Polythene Converters Limited, Canvey Island, United Kingdom

[21] Appl. No.: 08/981,657

[22] PCT Filed: Jun. 21, 1996

[86] PCT No.: PCT/GB96/01514

§ 371 Date: Dec. 22, 1997

§ 102(e) Date: Dec. 22, 1997

[87] PCT Pub. No.: WO97/01497

PCT Pub. Date: Jan. 16, 1997

[30] Foreign Application Priority Data

Jun. 24, 1995 [GB] United Kingdom ..... 9512917

[51] Int. Cl.[7] ..... B65D 90/00; B65D 90/12

[52] U.S. Cl. ..... 220/1.6; 220/1.5; 222/105; 296/39.1

[58] Field of Search ..... 220/1.5, 1.6; 222/105, 222/183; 296/39.1

[56] References Cited

U.S. PATENT DOCUMENTS 4,799,607 1/1989 Podd ..... 222/94
5,152,735 10/1992 Podd et al. ..... 493/95
5,181,625 1/1993 Podd et al. ..... 220/1.5
5,244,332 9/1993 Krein et al. ..... 414/467
5,595,315 1/1997 Podd et al. ..... 220/1.5
5,706,964 1/1998 Podd et al. ..... 220/1.5

*Primary Examiner*—Allan N. Shoap
*Assistant Examiner*—Joe Merek
*Attorney, Agent, or Firm*—Renner, Kenner, Greive, Bobak, Taylor & Weber

[57] ABSTRACT

A bulkhead assembly, for use with a cargo container (10) within which is provided a liner (15) for the bulk transport of flowable materials, has a plurality of elongate members (20) which extend upwardly from the floor (11) of the container, but with a central region (25) adjacent the container floor (11) free from obstruction. A flexible sheet (26) is folded to form two overlying layers (27, 28) joined together to define pockets in which are positioned two pairs of rigid plates (29, 30), the inner pair of plates (29) being spaced apart. In use, the sheet (26) is arranged adjacent the container floor, so as to extend over the central region (25), and also to provide corner fillets for the container, the lower region of the liner when in use being supported by the sheet (26) and the plates (29, 30).

17 Claims, 1 Drawing Sheet

CONTAINER BULKHEAD ASSEMBLY

This invention relates to a bulkhead assembly for use within a container and in conjunction with a liner, for the bulk transport of flowable particulate products. The invention further relates to such a bulkhead assembly in combination with a container and a container liner, for the transport of such products.

BACKGROUND OF THE INVENTION

Containers of standardised sizes are ever more being used for the transport of products. The products may be packaged appropriately and then the packages loaded into the container, or—depending upon the nature of the products—those products may be loaded directly into the container. In order to allow the direct loading of particulate products, such as powders, granules or the like, it is known to fit within a container a bag-like flexible liner for example of polyethylene which liner is provided with an inlet accessible when the liner has been fitted into a container, whereby a bulk product may be loaded into the liner for transport. A wide variety of particulate materials may be carried in bulk in this way, and in view of the isolation of the product from the ambient, even food products may conveniently be transported.

The conventional way of discharging a powder-like material carried in a liner within a container is to allow the material to run under gravity out of a discharge provided at one end of the liner, by tipping the container. The wall of the container in the region of the discharge may be provided with a hatch having a door which, when opened, gives access to the discharge of the liner. In an alternative arrangement, within the end of the container having conventional doors, there is provided a bulkhead assembly to retain the load and liner in position,, the assembly having an aperture giving access to the liner discharge. When the container is to be discharged, the container doors are opened and then access is gained to the discharge through the aperture in the bulkhead assembly. Examples of the above arrangements are described in GB-A-2 264 695 and U.S. Pat. No. 5 152 735.

There have been several proposals for bulkhead assemblies suitable for use in the above-described manner. Such a bulkhead assembly should be relatively cheap to manufacture since it usually is used only once, and frequently such structures are manufactured on site from lengths of timber appropriately cut to size. In an attempt to reduce the manufacturing time and also the cost of such a assembly, it is known to provide as few structural members as possible extending both vertically from the floor to the top of the container and horizontally from side to side, and then to use those members to support a rigid board—for example of plywood or blackboard—which extends across the width of the container. However, a certain amount of cutting and fabrication of the board is required with this arrangement, in order to allow access to the discharge of the liner.

SUMMARY OF THE INVENTION

It is an aim of the present invention to provide a bulkhead assembly suitable for use in a container in conjunction with a liner for the bulk transport of particulate product, which assembly is relatively quick and easy to install and yet which gives adequate support to a loaded liner within the container.

According to the present invention, there is provided a bulkhead assembly for use within a container in conjunction with a liner for the bulk transport of flowable particulate products in the container, which bulkhead assembly comprises a plurality of elongate members which extend, when installed in a container, upwardly from the floor of the container at the doored end thereof, the members being arranged to leave a central region adjacent the floor of the container free from obstruction by the members, a flexible severable sheet extending across said central region and bearing on surfaces of said members facing the interior of the container, and at least one substantially rigid liner-supporting plate secured to the severable sheet and disposed with respect to the members so as not to obstruct said central region, the liner-supporting plate bearing on at least one member, whereby a liner in the form of a bag fabricated from a flexible plastics sheet may be located within the container with an outlet area of the liner being supported in use by said flexible severable sheet and by the plate In the present invention, a bulkhead assembly has a plurality of elongate members which advantageously are interconnected to form a framework, much as is already known in this art, and at least the lower central region of that framework is left clear to give access to the discharge region of a liner suspended within a container in which the bulkhead assembly is installed. To give adequate support to that liner when loaded in the lower central region, a flexible relatively strong but severable sheet is arranged across that lower central region, and at least one liner-supporting plate is secured to that sheet at such a location that the central region is not obstructed thereby. In use, the liner may bear on and be supported by that sheet and also by the supporting plate, but the liner may still be discharged in the usual way by an operator slashing with a knife through the sheet, as well as through the liner itself. Of course, in practice both the sheet and the liner will be slit with the knife at the same time. Alternatively, for a case where the liner is provided with a discharge tube, the severable sheet may be precut and then that cut closed for example with adhesive tape, a clasp fastener or other suitable closure means. Then, when the liner is to be discharged, the cut may be opened to gain access to the liner discharge tube. Yet another possibility is for the severable sheet to have lines of weakness, such as perforations, whereby the sheet may easily be torn open along those lines.

Though only one substantially rigid plate, of a suitable shape, could be secured to the sheet, in a particularly preferred form of this invention a pair of liner-supporting plates are secured to the sheet, each plate being of generally triangular form and secured to the sheet at locations such that when in use in a container the plates extend diagonally across the two lower corner regions at the bulkhead end of the container. Such plates may thus take the form of corner fillets for the container, known per se, but by securing the plates to the sheet before the sheet is fitted to the upright members, the provision of corner fillets in the container may be achieved rapidly without the need to attach the corner fillets to the container.

In addition to said pair of plates serving as corner fillets, or perhaps alternatively, a pair of substantially rigid upright plates may be secured to the sheet, one such plate to each side of the central region, respectively. Each upright plate could be essentially rectangular and extend to the respective side of the container, but where a pair of corner fillet plates are provided, each upright plate may be of substantially right-angle triangular shape arranged with one edge extending vertically, adjacent said central region, and with another edge extending immediately adjacent a diagonal edge of the respective corner fillet plate. In either case, each upright plate is preferably attached to the members over which the respective plate is disposed. In turn, this will serve to secure the sheet to those members.

BRIEF DESCRIPTION OF THE DRAWINGS

In a preferred embodiment, the severable sheet may have two layers with the, or each, substantially rigid plate located therebetween. The layers may be formed by providing a single sheet which is folded over to define the two layers. These layers may be joined together at least along part of their peripheries so that the two layers define one or more pockets in which are located the or each plate.

The severable sheet typically may comprise a sheet of flexible plastics material similar to that of the liner itself, but preferably of a significantly thicker gauge of material. Typically, the severable sheet may be of a greater strength than that of the liner with which the bulkhead assembly is to be used. For example, both that sheet and the liner may be of a polyethylene, with the gauge of the sheet being perhaps twice that of the liner. In order to give stability to the position of the sheet, it may be secured to the inside surfaces of the members for example by stapling, nailing or by using adhesives, conveniently in the form of double-sided adhesive tape.

There may be provided a substantially rigid panel disposed above the sheet and which also bears on said inwardly-directed surfaces of the members, so as to support the upper region of a liner loaded with product. The panel may be loose for fitting in its final position after the bulkhead assembly has been completed and the liner suspended within the container.

In such a case, the panel may in use bear on the upper edges of the plates, when provided as a part of the bulkhead assembly.

This invention extends to a bulkhead assembly of the invention as described above, in combination with a container in which the bulkhead is mounted and a flexible bag-like liner suspended within the container.

BRIEF DESCRIPTION OF THE DRAWINGS

Figure 2:
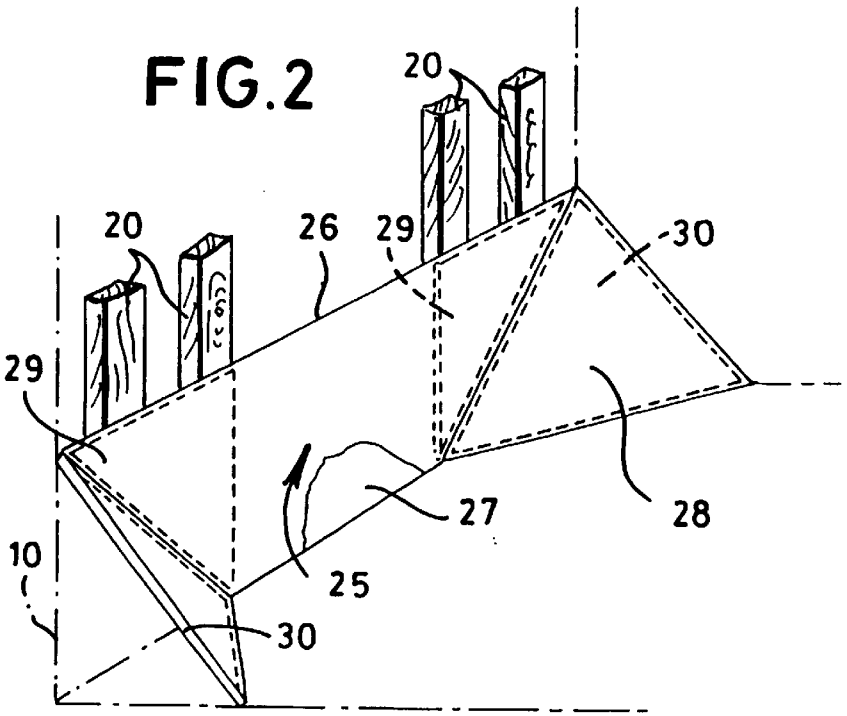
Figure 1:
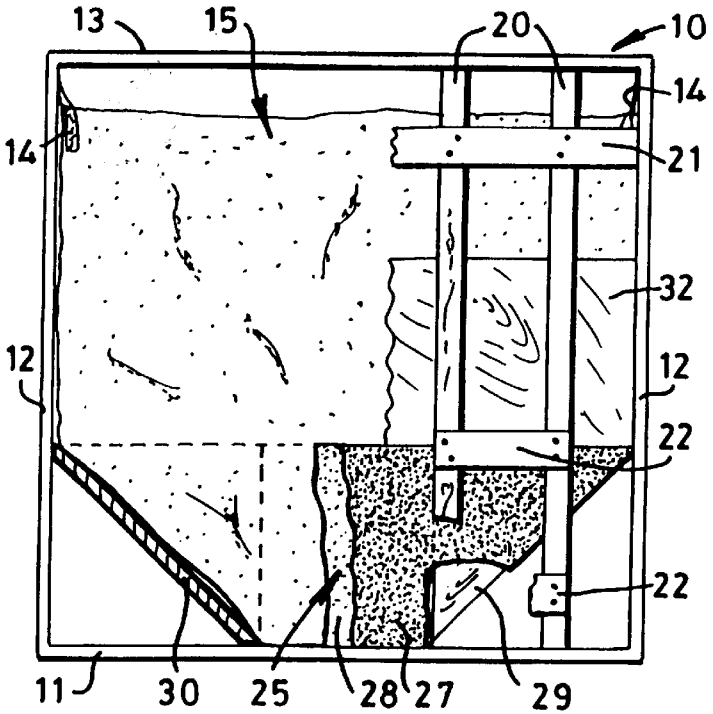

By way of example only, one specific embodiment of bulkhead assembly of this invention will now be described in detail, with reference to the accompanying drawings, in which:

FIG. 1 is an end view on a container including the bulkhead assembly and a flexible liner fitted therewithin;

FIG. 2 is a diagrammatic view of a part of the bulkhead assembly; and

Figure 3:
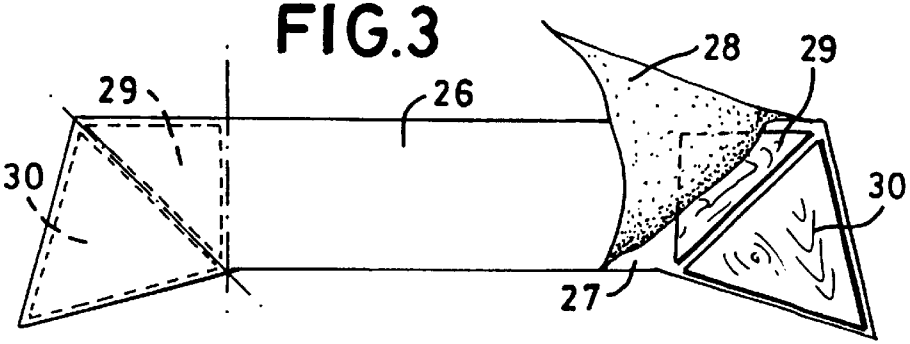

FIG. 3 shows the flexible sheet employed in the bulkhead assembly, with the triangular boards in place but before attachment to the bulkhead assembly.

DETAILED DESCRIPTION OF A PREFERRED EMBODIMENT

In FIG. 1, there is shown a conventional container 10 having a floor 11, a pair of side walls 12 and a top 13. The further end of the container is closed but the end shown in the drawings is provided with a pair of doors (not shown). Suspended within the container, by means of tapes 14, is a bag-like liner 15 fabricated from flexible plastics material sheet. That liner forms no part of the present invention.

In order to retain the liner when loaded within the container, even should the doors of the container be opened, there is provided across the doored end of the container a bulkhead assembly. This assembly is fabricated from four upright wooden members 20 (only two of which are shown in FIG. 1) and one upper cross member 21 extending across all four upright members 20, from one side of the container to the other. Adjacent the lower end of the container, there are provided on each side two short cross members 22, extending between the pairs of upright members, to each side of the centre-line. The wooden members typically should be cut to size on site to suit the container to be loaded, and the members nailed together and secured to the containers in the conventional way.

The lower central region 25 between the two inner upright members 20 is covered by a flexible sheet 26 having two distinct layers 27 and 28. Such a sheet may be formed by appropriately shaping a piece of relatively thick gauge polyethylene, folding that sheet to form two overlying layers and welding together adjacent edges. Prior to completing the welds, two pairs of triangular rigid boards 29 and 30, for example of plywood, may be located between the sheets, as shown in FIG. 3. The boards are appropriately dimensioned such that the complete sheet may be fitted to the upright members 20 as shown in FIGS. 1 and 2, with the inner boards 29 extending vertically against the upright members 20 and the outer boards 30 forming corner fillets for the container. The sheet 26 may be secured in position by means of nails or staples extending through the layer 28, boards 29, layer 27 and into the members 20. The sheet 26 serves to locate the boards 30 in the appropriate positions as corner fillets, without the need separately to secure those boards to the container, though those boards may be secured to the container, if desired.

Once the bulkhead assembly has been fabricated as described above, the liner 15 may be located within the container, using the tapes 14 as mentioned above. Then, a further board 32, for example of plywood or cardboard, is located within the container, resting on the upper edges of the boards 29 and bearing against the inside faces of the members 20. That board may lightly be held in position, for example by means of a double-sided adhesive tape between the upright members 20 and the board itself. There is no need for the board to be securely held in position, since the weight of the product within the liner, when loaded, will serve to press that board against the members 20.

It will be appreciated that the bulkhead assembly described above is relatively cheap and simple to fabricate on-site, to fit a given container. The component parts of the bulkhead assembly are common materials which may be re-used or used only once and then disposed of, though perhaps salvaged for re-use for other purposes.

We claim:

1. A bulkhead assembly for use within a container having a doored end, in conjunction with a liner for the bulk transport of flowable particulate products in the container, which bulkhead assembly comprises a plurality of elongate members which extend, when installed in a container, upwardly from the floor of the container at the doored end thereof, the members being arranged to leave a central region adjacent the floor of the container free from obstruction by the members, a flexible severable sheet extending across said central region and bearing on surfaces of said members facing the interior of the container, at least one substantially rigid liner-supporting plate secured to the severable sheet and disposed with respect to the members so as not to obstruct said central region, the liner-supporting plate bearing on at least one member, when a liner in the form of a bag fabricated from a flexible plastics sheet is located within the container with an outlet area of the liner being supported in use by said flexible severable sheet and by the at least one liner-supporting plate, and a pair of substantially rigid upright plates secured to the severable sheet, one upright plate to each side of the central region and extending substantially to the respective side of the container, when in use, wherein each said upright plate of said pair thereof is of substantially right angle triangular shape and is arranged with one edge extending upwardly adjacent said central region, and with another edge extending immediately adjacent a diagonal edge of the respective liner-supporting plate.

2. A bulkhead assembly as claimed in claim 1, wherein there is provided a pair of substantially rigid liner-supporting plates each of generally triangular form and secured to said severable sheet at locations such that when in use in a container the plates extend diagonally across the twO lower corner regions at the bulkhead end of the container.

3. A bulkhead assembly as claim 1, wherein each said upright plate is attached to the elongate members over which the respective plate is disposed.

4. A bulkhead assembly as claimed in claim 1, wherein said severable sheet is attached to the elongate members.

5. A bulkhead assembly as claimed in claim 4, wherein each said upright plate of said pair thereof is of substantially right angle triangular shape and is arranged with one edge extending upwardly adjacent said central region, and with another edge extending immediately adjacent a diagonal edge of the respective liner-supporting plate.

6. A bulkhead assembly for use within a container having a doored end, in conjunction with a liner for the bulk transport of flowable particulate products in the container, which bulkhead assembly comprises a plurality of elongate members which extend, when installed in a container, upwardly from the floor of the container at the doored end thereof, the members being arranged to leave a central region adjacent the floor of the container free from obstruction by the members, a flexible severable sheet having two layers extending across said central region and bearing on surfaces of said members facing the interior of the container, and at least one substantially rigid liner-supporting plate secured to and being disposed between the two layers of the severable sheet and further disposed with respect to the members so as not to obstruct said central region, the liner-supporting plate bearing on at least one member, when a liner in the form of a bag fabricated from a flexible plastics sheet is located within the container with an outlet area of the liner being supported in use by said flexible severable sheet and by the plate.

7. A bulkhead assembly as claimed in claim 6, wherein the two layers of the severable sheet are defined by single sheet of material which is folded to form the overlying layers.

8. A bulkhead assembly as claimed in claim 7, wherein the two layers of the severable sheet are joined together at least along parts of their peripheries so as thereby to define one or more pockets in which are located the or each plate.

9. A bulkhead assembly as claimed in claim 8, wherein the or each plate is sealed in the respective pocket.

10. A bulkhead assembly as claimed in claim 1, wherein there is provided a substantially rigid panel disposed above the severable sheet and which also bears on said inwardly-directed surfaces of the elongate members.

11. A bulkhead assembly as claimed in claim 10, wherein the panel when in use bears on the upper edge of at least one of the plates secured to the severable sheet.

12. A bulkhead assembly as claimed in claim 1 in combination with a container within which the bulkhead assembly is mounted and a flexible bag-like liner located within the container.

13. A bulkhead assembly for use within a container having a doored end in conjunction with a liner for the bulk transport of flowable particulate products in the container, which bulkhead assembly comprises a plurality of elongate members which extend, when installed in a container, upwardly from the floor of the container at the doored end thereof, the members being arranged to leave a central region adjacent the floor of the container free from obstruction by the members, a flexible severable sheet extending across said central region and bearing on surfaces of said members facing the interior of the container, a pair of substantially rigid liner-supporting plates each of generally triangular form and secured to the severable sheet at locations such that when in use in a container the plates extend diagonally one across each of the two lower corner regions at the bulkhead end of the container, thereby to form corner fillet plates, the liner-supporting plates each bearing respectively on at least one member, and a pair of substantially rigid upright plates of substantially right angle triangular shape also secured to the severable sheet, one upright plate to each side of the central region, respectively, and each said upright plate being arranged with one edge extending upwardly adjacent said central region and with another edge extending immediately adjacent a diagonal edge of the respective liner-supporting plate, when a liner in the form of a bag fabricated from a flexible plastics sheet is located within the container with an outlet area of the liner being supported in use by said flexible severable sheet and by the plate.

14. A bulkhead assembly as claimed in claim 13, wherein each said upright plate extends substantially to the respective side of the container, when the bulkhead is installed in the container.

15. A bulkhead assembly as claimed in claim 13, wherein said severable sheet is attached to the elongate members.

16. A bulkhead assembly as claimed in claim 15, wherein the two layers of the severable sheet has two layers, the or each substantially rigid plate being disposed between the two layers of the sheet.

17. A bulkhead assembly as claimed in claim 15, wherein the two layers of the severable sheet are joined together at least along parts of their peripheries so as thereby to define a plurality of pockets in which are located the liner-supporting plates.

* * * * *